US005598866A

United States Patent [19]

Nelson

[11] Patent Number: 5,598,866

[45] Date of Patent: Feb. 4, 1997

[54] PORTABLE WELL TESTING APPARATUS

[76] Inventor: Cliff H. Nelson, RR 5, Calgary, Alberta, Canada, T2P 2G6

[21] Appl. No.: 554,631

[22] Filed: Nov. 6, 1995

[51] Int. Cl.[6] ..... B65H 75/34

[52] U.S. Cl. ..... 137/355.12; 137/355.26; 137/355.27

[58] Field of Search ..... 137/355.12, 355.26, 137/355.27

[56] References Cited

U.S. PATENT DOCUMENTS

| | | | |
|---|---|---|---|
| 3,774,630 | 11/1973 | Prange | 137/355.26 |
| 4,306,682 | 12/1981 | Toussaint | 137/355.27 |
| 4,732,345 | 3/1988 | Golden | 137/355.27 |
| 4,757,838 | 7/1988 | McGullion | 137/355.27 |
| 4,793,376 | 12/1988 | Hare | 137/355.27 |
| 4,945,938 | 8/1990 | Ponsford et al. | 137/355.26 |
| 5,139,751 | 8/1992 | Mansfield et al. | 137/355.12 |
| 5,211,203 | 5/1993 | Vollweiler et al. | 137/355.26 |
| 5,275,198 | 1/1994 | Vollweiler et al. | 137/355.17 |
| 5,289,875 | 3/1994 | Stokley et al. | 166/264 |
| 5,323,800 | 6/1994 | Vollweiler et al. | 137/240 |

*Primary Examiner*—A. Michael Chambers
*Attorney, Agent, or Firm*—Jerry T. Kearns

[57] ABSTRACT

A frame structure arranged for ease of retrofit to an existing truck bed includes telescoping legs from the associated frame structure to orient a guide roller as desired to be positioned overlying a well entrance opening. A reel rotatably mounted and motor driven and controlled supports a first hose having a sump pump arranged for submersible positioning within the well. Upon positioning of the sump pump within the well, power supply to the sump pump to direct fluid extraction from the well for providing test samples from the associated well is provided. To this end, the compact and convenient organization permits ease of use as well as convenience in transport and storage of the organization relative to a water well testing apparatus.

15 Claims, 5 Drawing Sheets

PORTABLE WELL TESTING APPARATUS

BACKGROUND OF THE INVENTION

1. Field of the Invention

Environmental concerns relative to ground water has become a concern in contemporary society and testing for environmental contamination mandatory, if not necessary, relative to the use of potable drinking water. Typically, contamination of ground water relative to natural and artificial waste such as chemical leakage, chemical fertilizer, and the like has created a need for testing of ground water on a regular basis. Underground water such as aquifers are a direct source of water but are also a supply for many surface water bodies also used as drinking water, such as reservoirs and the like. Environmental testing has become quite sophisticated, but a need to extract samples of underground water is necessary and to this end, portable water well testing equipment is required.

2. Description of the Prior Art

The prior art has developed a variety of underground water testing structure such as indicated in U.S. Pat. No. 5,275,198 granted to Vollweiler, et al. To this end, a driven spool mounted to a boom is typically secured to the back of a truck or trailer, with the hydraulically operated boom permitting the lowering of a hose and sump pump into a well.

U.S. Pat. No. 3,774,630 issued to Prange sets forth a mobile sewer conduit cleaning machine having a hose and reel mounted within a truck body in a permanent relationship to permit the lowering of a hose into an underground sewage system.

U.S. Pat. No. 5,323,800 issued to Vollweiler, et al. sets forth water sampling structure of analogous association to U.S. Pat. No. 5,275,198 permitting a washer for high or low pressure washing of balers or other devices to sample well water.

U.S. Pat. No. 5,289,875 issued to Stokley, et al. sets forth an apparatus for obtaining fluid samples from underground wells, with a truck-mounted reel permitting the lowering of a hose into a well having a separate pump supply structure.

While the aforementioned devices disclose representative examples of prior art water well sampling structure, one may appreciate that the an is relatively crowded and with none of the aforementioned devices disclosing a portable well testing structure arranged for ease of retrofit relative to an existing truck body and ease of positioning the structure and orientating the hose and pump in a convenient manner relative to an underlying well, as proposed by the instant invention.

SUMMARY OF THE INVENTION

A frame structure arranged for ease of retrofit to an existing truck bed includes telescoping legs from the associated frame structure to orient a guide roller as desired to be positioned overlying a well entrance opening. A reel rotatably mounted and motor driven and controlled supports a first hose having a sump pump arranged for submersible positioning within The well. Upon positioning of the sump pump within the well, power supply to the sump pump to direct fluid extraction from the well for providing test samples from the associated well is provided. To this end the compact and convenient organization permits ease of use as well as convenience in transport and storage of the organization relative to a water well testing apparatus.

These and various other advantages and features of novelty which characterize the invention are pointed out with particularly in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figure 1:
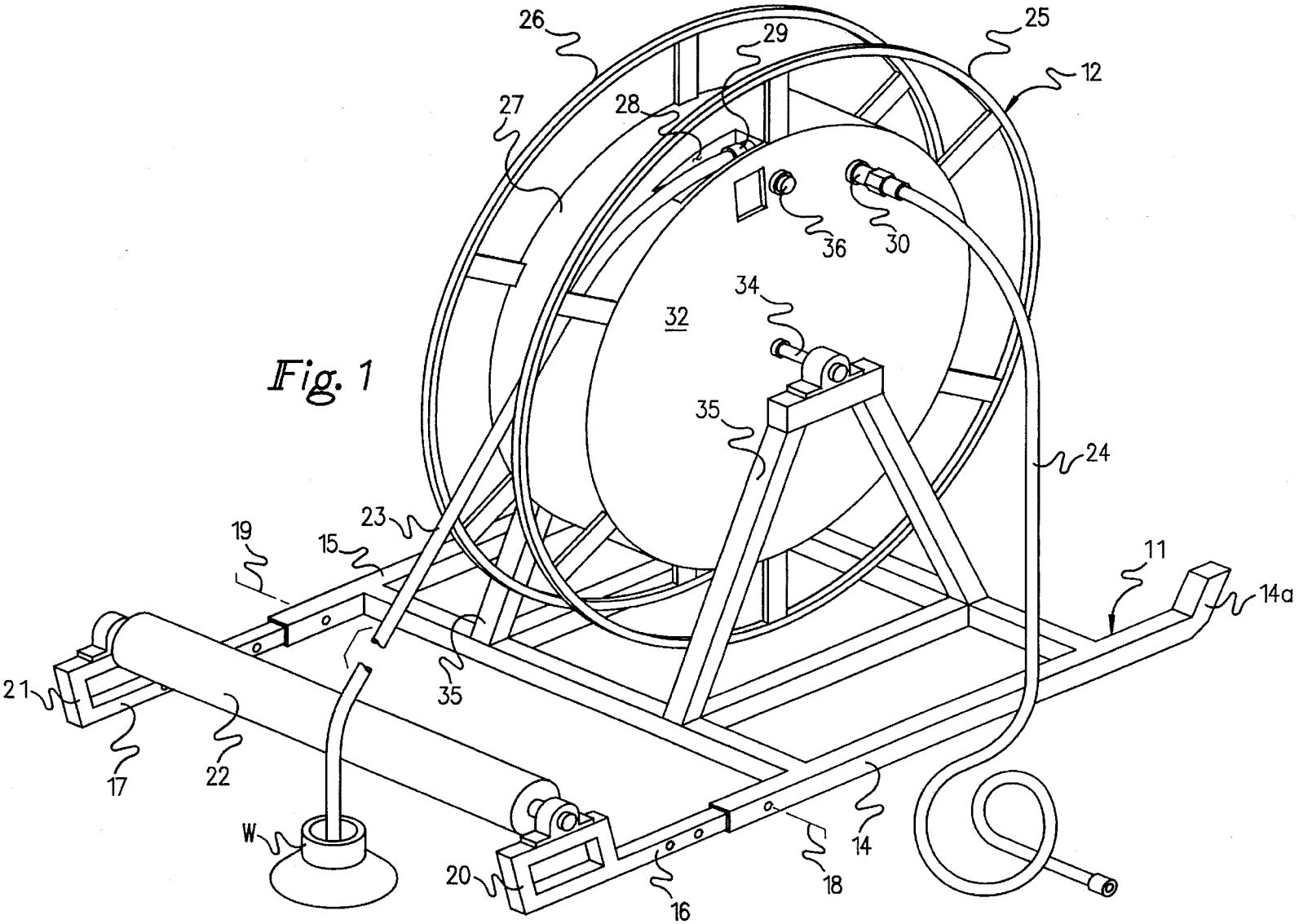
FIG. 1 is a perspective illustration of the invention.

Referring now to the drawings, wherein like reference numerals designate corresponding structure through the views, and referring in particular to FIGS. 1 through 7, a portable well testing apparatus 10 according to the preferred embodiment will now be described.

Figure 2:
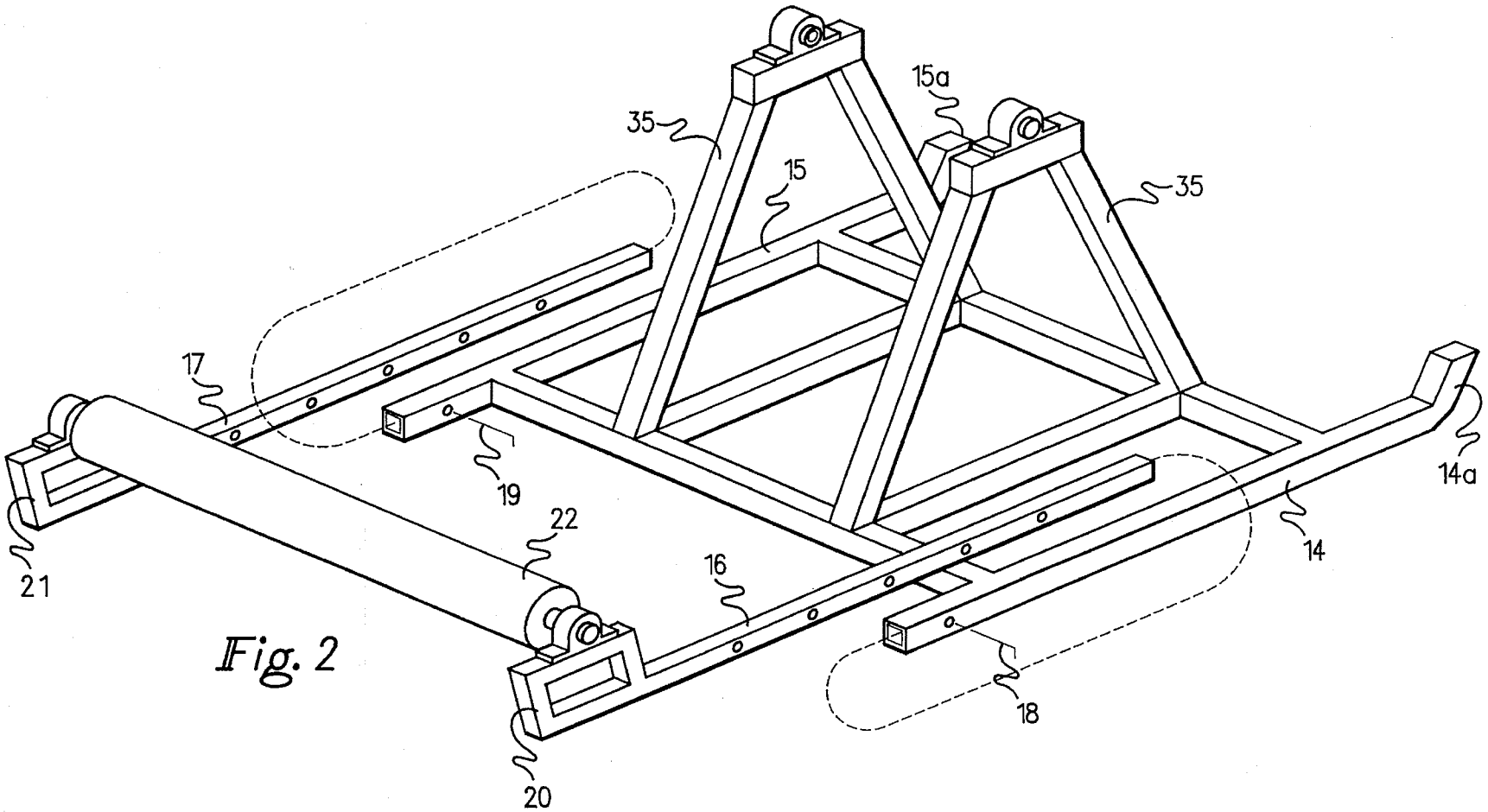
FIG. 2 is a perspective exploded illustration of the frame structure of the invention indicating the extensible legs for orientation of the guide roller relative to the frame structure.
Figure 4:
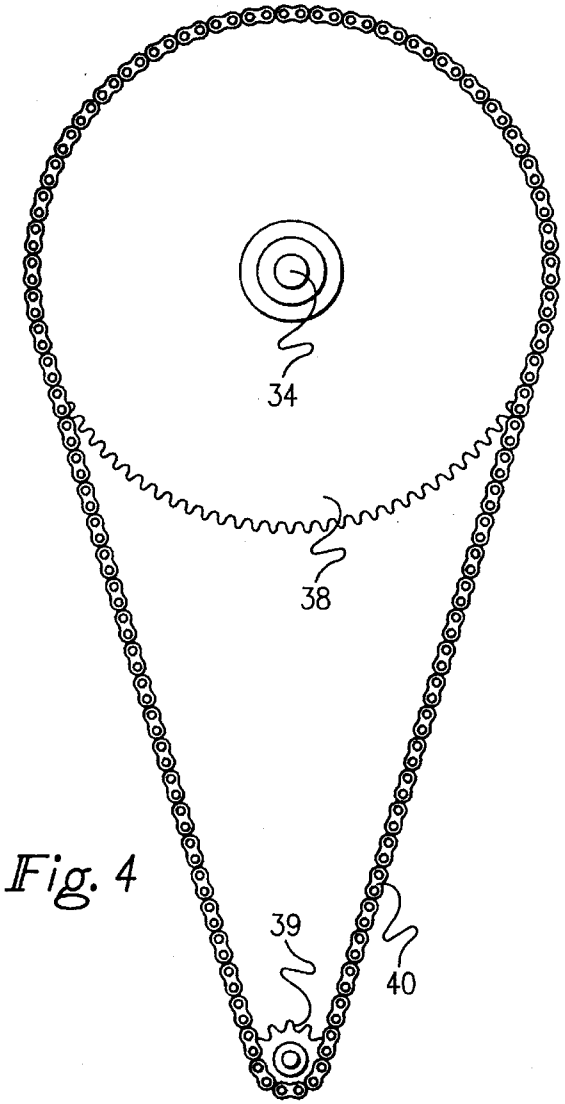
FIG. 4 is an elevational view of the first and second sprockets associated by a common drive chain.
Figure 3:
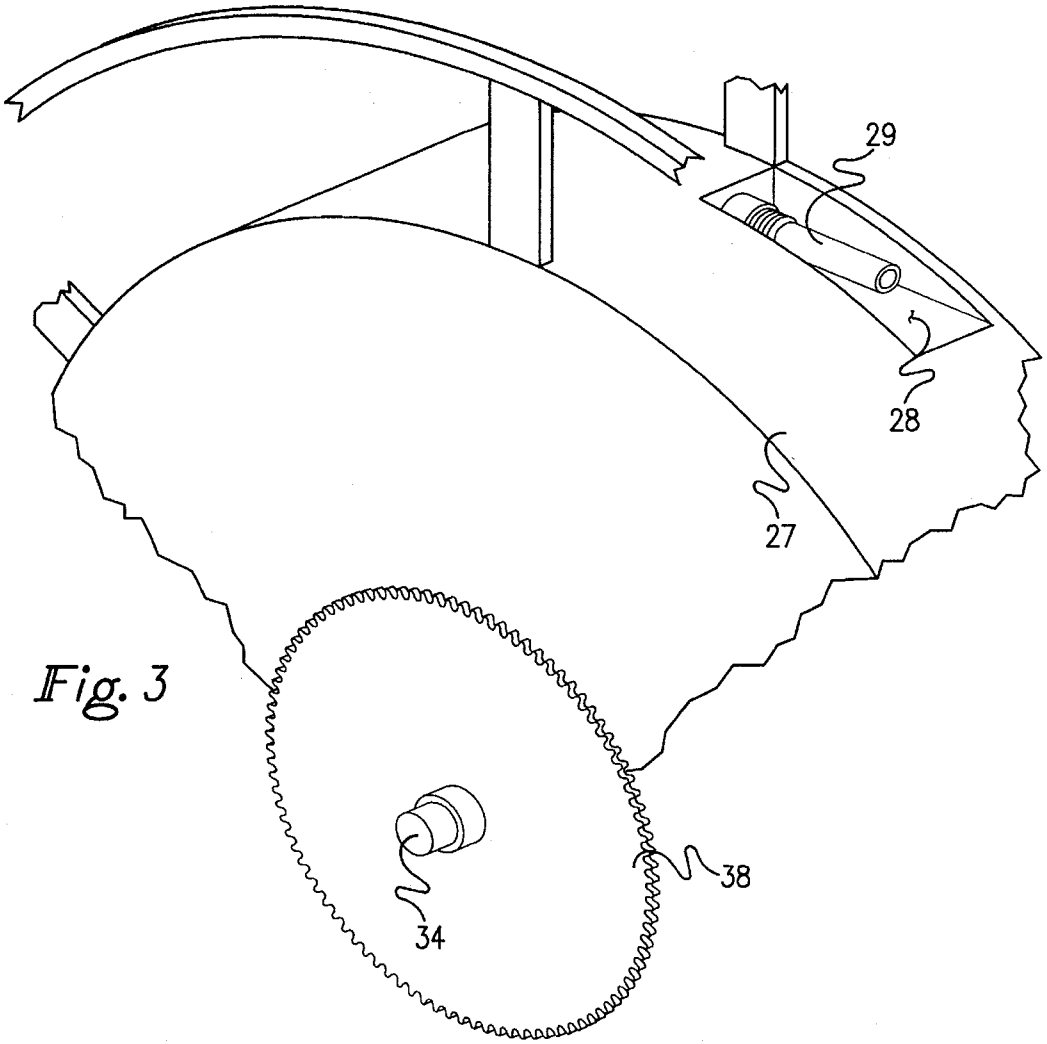
FIG. 3 is a partial perspective illustration of the reel and sprocket structure associated with the reel.
Figures 5, 6:
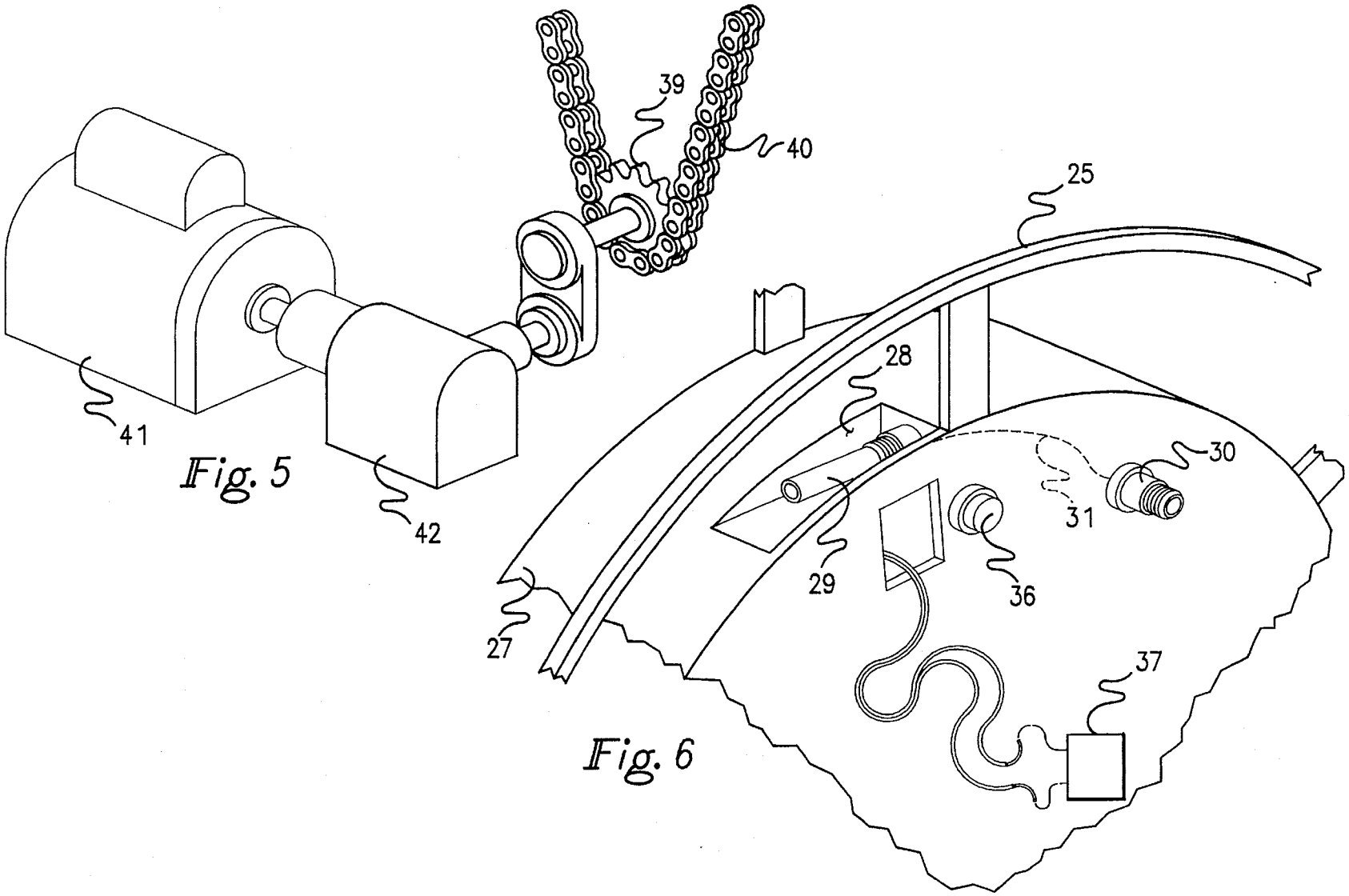
FIG. 5 is a perspective illustration of the drive motor and transmission directed to the second sprocket.
FIG. 6 is a partial perspective view illustrating the first and second conduit connectors fixedly mounted relative to the reel.
Figure 7:
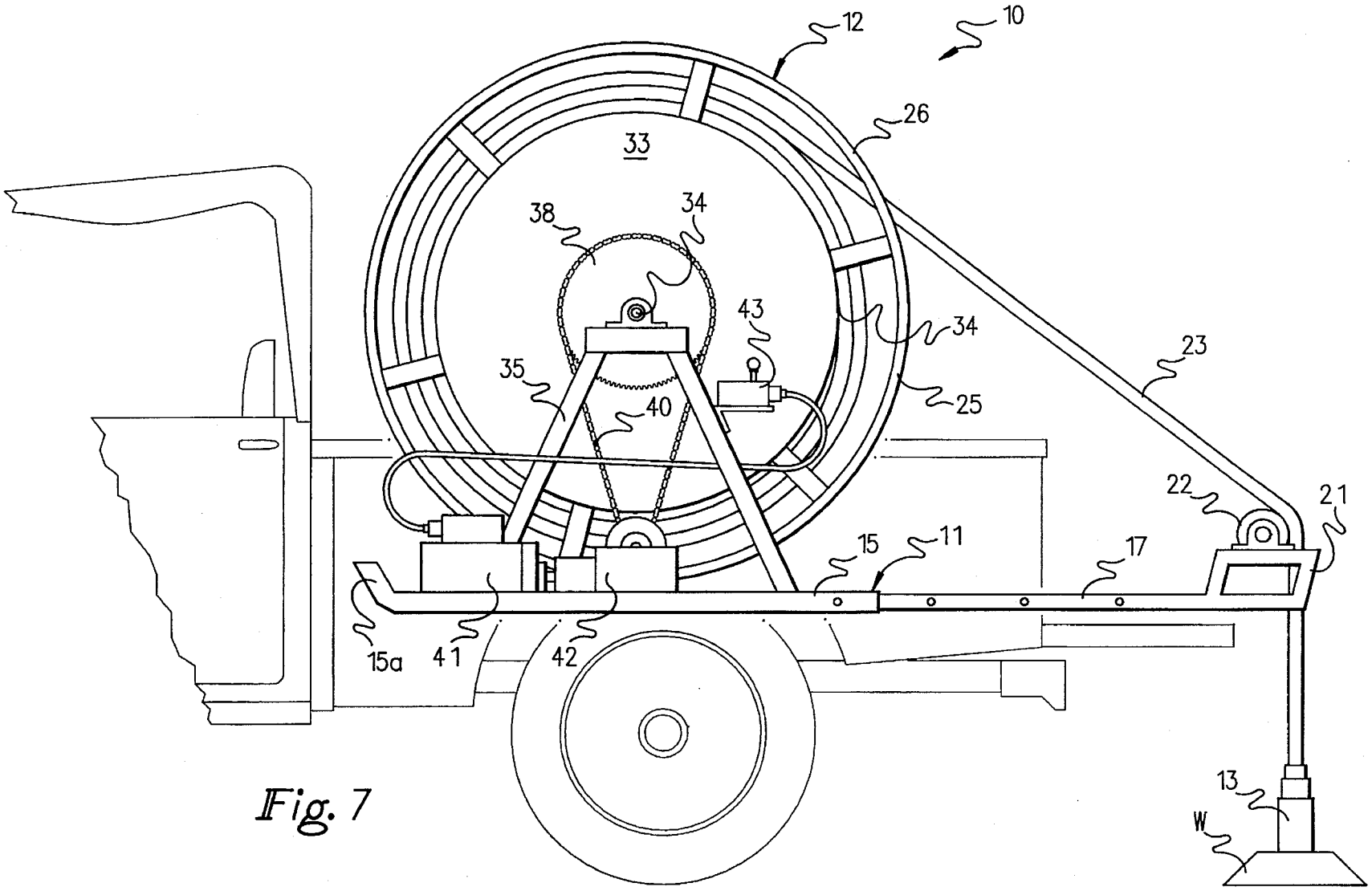
FIG. 7 is a side elevational view of the invention mounted in a retrofit manner to a conventional pickup truck bed.

A portable well testing apparatus 10 comprises support frame 11, such as is indicated in the FIGS. 1 and 2 for example. The support frame includes a first tube 14 spaced from a second tube 15, with a respective first and second extension leg 16 and 17 telescopingly received within the respective first and second tubes 14 and 15. To this end, an opening is directed through the first tube 14, with a similar opening directed through the second tube 15. The first and second extension legs 16 and 17 have respective arrays of openings, with an opening of each array arranged for alignment with a respective one of the openings in the first and second tubes 14 and 15, such that a first lock pin 18 is directed through the first tube 14 and one of the array of apertures within the first extension leg 16. Similarly, a second lock pin 19 is directed through the opening in the second leg 15 and one of the array of openings within the second extension leg 17. A first boss 20 is integral with an outer distal end of the first extension leg 16 and projects thereabove, wherein in a like manner, a second boss 21 is integral with an outer distal end of the second extension leg 17 and projects thereabove. The first and second bosses 20 and 21 rotatably mount a guide roller 22 therebetween. As may be appreciated, and with particular reference to FIG. 7, the support frame 11 is readily positioned within a truck body, such that when the tailgate is dropped, such as illustrated in FIG. 7, the first and second extension legs may be telescopingly directed to project beyond the tailgate thereby positioning the guide roller in a convenient manner over an associated well head "W". Further, for ease of directing the support frame 11 within the truck body, the first tube 14 includes a first arcuate end 14*a* and the second tube 15 is provided with a second arcuate end 15*a* to permit ease of sliding of the support frame 11 upon the truck bed to direct the support frame 11 in a convenient manner within the truck bed. It may also be appreciated that subsequent to use, the first and second extension legs 16 and 17 upon removal of the first and second lock pins 18 and 19 are retracted within respective first and second tubes 14 and 15 to permit the tailgate to be lifted and latched and thereby to transport and store the apparatus 10 in a convenient manner. Secured to the frame 11 and extending thereabove are a pair of frame extensions 35 that rotatably mount a reel axle 34 therebetween. Typically, the axle 34 is oriented in a parallel relationship relative to the guide roller 22, but is not limited to such construction but is generally preferred to maintain alignment of a fluid hose to be withdrawn from the associated reel structure 12. To this end, the reel structure 12 is secured to the axle 34, such that upon rotation of the axle 34, the reel 12 rotates therewith. The reel 12 includes spaced first and second side walls 32 and 33, with a first circular guide rail 25 substantially aligned with the first side wall 32 extending thereabove in a circumferential manner, with a second circular guide rail 26 spaced from the second side wall 33 extending beyond the second side wall 33, with a reel support surface 27 extending between the first and second side walls 32 and 33, as well as between the first and second guide rails 25 and 26, with the support surface 27 defined by a support surface diameter substantially less than that of a guide rail diameter 25 and 26, such that a first fluid hose 23 is wound about and supported upon the support surface 27 between the first and second guide rails 25 and 26, in a manner as exemplified in FIG. 7. The first fluid hose 23 is arranged for securement to a first conduit connector 29 that is positioned within a support recess 28 within the support surface 27, such that the first conduit connector 29 does not interfere with the winding of the first fluid hose 23 about the support surface 27. A second conduit connector 30 projects from the first side wall 32, in a manner as exemplified in the FIGS. 1 and 6 for example, with a connector member 31 illustrated in phantom fluid coupling the first connector 29 to the second connector 30. The connector member may be of any desired type, such as a well, a fluid hose, and the like to fluidly connect the first connector 29 to the second connector 30.

At a free distal end of the first hose 23 is mounted a submersible pump 13. The submersible pump includes typically an electrical connection from the submersible pump within the first hose 23 directed to an on/off switch 36 permitting selective on/off communication of the submersible pump 13 to an electrical power supply, as illustrated in phantom in FIG. 6, through the on/off switch 36. Illustration of such connection is exemplified in the U.S. Pat. No. 5,275,198 incorporated herein by reference.

It is understood therefore that when the on/off switch 36 permits electrical communication between the electrical power supply 37 and the submersible pump 13 when the submersible pump is positioned within the associated well, fluid is directed through the first fluid hose 23, the first conduit connector 29, the connector member 31, the second connector 30, and then subsequently to a second fluid hose 24 of flexible construction whose free distal end permits collection of a water sample receiving water from the well "W".

A first sprocket 38 is fixedly secured to the reel axle 34, with a second sprocket 39 spaced therefrom, with the first and second sprockets 38 and 39 respectively connected by a drive chain 40. It is understood that various mechanical interconnection may be employed such as gears and the like, but for purposes of illustration, the utilization of a chain driven sprocket connection is employed. A drive motor 41 is mounted to the support frame 11 and wherein through a transmission 42 directs rotation of the second sprocket 39, wherein through the drive chain 40 effects rotation of the first sprocket 38 and accordingly the reel 12 by rotation of the reel axle 34. It is understood that the transmission 42 may be of any desired types of gear reduction, hydraulic, and the like available in the prior art. A motor control unit 43, such as illustrated in FIG. 7, connected to the frame 11 effects operation of the reversible drive motor 41 to permit a reeling and unreeling of the first fluid hose 23 relative to the reel 12. It is also understood that the second hose 24 is typically not connected until the unreeling event has transpired thereafter permitting securement of the second hose 24 to the second connector 30. Prior to feeling of the first hose 23, the second hose 24 is removed and subsequently stored in any convenient manner, such as within the truck bed of the truck, such as illustrated in FIG. 7.

It is to be understood, however, that numerous characteristics and advantages of the present invention have been set forth in the foregoing description, together with details of the structure and function of the invention, the disclosure is illustrative only. Changes may be made in detail, especially in matters of shapes, size, or arrangement of parts within the principle of the invention to the full extent indicated by the broad general meaning of the terms in which the appended claims are expressed.

What is claimed is:

1. A portable well testing apparatus, comprising:

support frame means arranged for sliding retrofit within a truck bed, a first fluid hose and a second fluid hose, reel means rotatably mounted to the support frame means for the reeling and unreeling of the first fluid hose relative to the reel means, and the reel means arranged for selective mounting of the second fluid hose to the reel means, with the first fluid hose and the second fluid hose in fluid communication relative to one another through the reel means, said reel means including a first side wall spaced from a second side wall, and a first guide rail extending beyond the first side wall and a second guide rail extending beyond the second side wall, with the first guide rail and the second guide rail spaced relative to one another, and a support surface extending from the first side wall to the second side wall recessed below the first guide rail and the second guide rail to rotatably mount the first hose thereabout, said support frame means including a plurality of frame extensions projecting above the first tube and the second tube, with an axle rotatably mounted between the frame extensions, and the reel means secured to the axle, and a pump means mounted to a free distal end of the first fluid hose for directing fluid to the first fluid hose.

2. The apparatus of claim 1 wherein the support frame means comprises a first tube spaced from a second tube, the first tube having a first extension leg telescopingly received within the first tube, and the second tube having a second extension leg telescopingly received within the second tube, with the first extension leg and the second extension leg interconnected relative to one another.

3. The apparatus as in claim 2 wherein interconnection of the first extension leg and the second extension leg comprises a guide roller extending between the first extension leg and the second extension leg.

4. The apparatus as in claim 2 wherein the first extension leg includes a first boss extending above the first extension leg, and a second boss extending above the second extension leg, with the guide roller mounted onto the first boss and the second boss spacing the guide roller above the first extension leg and the second extension leg.

5. Apparatus as in claim 1 wherein the support surface includes a support recess and a first conduit connector positioned within the recess, and a second conduit connector positioned onto the first side wall in fluid communication to the first conduit connector.

6. Apparatus as in claim 5 with a first fluid hose arranged for selective coupling to the second connector.

7. Apparatus as in claim 1 including an external electrical power supply and a submersible pump mounted to a free distal end of the first hose, with the external power supply in electrical communication with the submersible pump, including an on/off switch mounted to the reel means permitting selective electrical communication of the external electrical power supply to the submersible pump.

8. Apparatus as in claim 1 with a first sprocket mounted relative to the reel means, and a second sprocket spaced from the first sprocket, with the drive chain directed in communication with the first sprocket and the second sprocket, and drive means to effect selective rotation of the second sprocket for effecting selective rotation of the first sprocket and reel means.

9. Apparatus as in claim 8 including a transmission member between the drive motor and the second sprocket.

10. A portable well testing apparatus adapted for transport in the back of a truck, comprising:

a support frame including a pair of spaced, substantially parallel tubular frame members, a reel mounted for rotation on said support frame, a fluid hose connected to said reel for rolling and unrolling thereon, a pump connected to a distal end portion of said fluid hose for drawing water from a well to be tested, a guide roller mounted for rotation between outer end portions of a pair of extension legs, and inner end portions of said extension legs dimensioned for telescopic insertion into said tubular frame members such that said guide roller may be adjustably connected to said support frame for positioning over a well to be tested to allow lowering of said pump connected to said fluid hose into the well, and whereby said extension legs may be selectively removed from said support frame for transport.

11. Apparatus as in claim 10, wherein said tubular frame members include arcuate end portions to facilitate sliding of said support frame onto a truck bed.

12. Apparatus as in claim 10, wherein said reel includes a first fluid connector disposed in a recess, with said fluid hose connected in fluid communication with said fluid connector.

13. Apparatus as in claim 12, further comprising a second fluid connector secured in fluid communication with said first fluid connector, and a second hose disposed for selective securement to said second fluid connector.

14. Apparatus as in claim 10, further comprising a driven sprocket connected in operative engagement with said reel, a drive sprocket disposed in spaced relation with said driven sprocket, a drive member connected said drive and driven sprockets, and a drive motor operably connected for selective rotation of said drive sprocket.

15. A portable well testing apparatus, comprising:

a support frame, the support frame having a first tube spaced from a second tube, the first tube having a first arcuate end, the second tube having a second arcuate end, and a first extension leg retractably and securably mounted relative to the first tube spaced from the first arcuate end, and the second tube having a second extension leg retractably and extensibly mounted relative to the second tube spaced from the second arcuate end, the first extension leg and the second extension leg having a guide roller extending therebetween, and the guide roller projecting above the first extension leg and the second extension leg, and a plurality of frame extensions projecting above the support frame, and an axle extending between the frame extensions, a reel member secured to the axle, and drive means mounted to the support frame arranged for effecting selective rotation of the axle and the reel member, and the reel member having spaced guide rails, with a support surface extending between the guide rails, and a first hose wound about the reel member, with the support surface having a support recess and a first conduit connector positioned within the recess, and the first hose connected to the first connector, the reel member having spaced first and second side walls, with the first side wall having a second connector, and a second hose arranged for selective securement to the second connector, and the second connector in fluid communication with the first connector, the first hose having a submersible pump mounted to the first hose at a free distal end thereof, with a submersible pump arranged for directing fluid through the first hose, the reel member, and the second hose.

* * * * *